US006229982B1

(12) United States Patent
Yamauchi et al.

(10) Patent No.: US 6,229,982 B1
(45) Date of Patent: May 8, 2001

(54) FIXING APPARATUS, FIXING METHOD AND IMAGE FORMING APPARATUS

(75) Inventors: Shin Yamauchi, Tokyo; Yoshihiko Eguchi, Hino, both of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/559,429

(22) Filed: Apr. 27, 2000

(51) Int. Cl.[7] ..... B05C 11/00; H05B 1/00; G03G 15/20

(52) U.S. Cl. ..... 399/327; 118/60; 219/216; 399/122; 399/328; 399/330

(58) Field of Search ..... 118/60; 219/216; 399/107, 122, 123, 320, 322, 324, 325, 326, 327, 328, 330, 331

(56) References Cited

U.S. PATENT DOCUMENTS 4,682,878 * 7/1987 Takizawa et al. ..... 399/322
5,450,181 * 9/1995 Tsukida et al. ..... 399/322
5,655,201 * 8/1997 Islam et al. ..... 399/322
5,689,789 * 11/1997 Moser ..... 399/331
5,749,037 5/1998 Takayuki ..... 399/327

* cited by examiner

*Primary Examiner*—Arthur T. Grimley
*Assistant Examiner*—Hoang Ngo
(74) *Attorney, Agent, or Firm*—Foley & Lardner

(57) ABSTRACT

A fixing apparatus having a fixing section and a cleaning roller. The fixing section has a pair of fixing rollers. The fixing section is designed to fix a developer image on a paper sheet as the paper sheet having the developer image transferred passes through a nip between the fixing rollers. One of the fixing rollers has a diameter gradually decreasing toward middle portion from either end portion. The cleaning roller is set in contact with said one of the fixing rollers. The cleaning roller removes, from said one of the fixing rollers, dirt such as toner stuck to said one of the fixing rollers during the process of fixing the developer image on the paper sheet. The cleaning roller has a diameter gradually increasing toward a middle portion from either end portion.

15 Claims, 2 Drawing Sheets

FIXING APPARATUS, FIXING METHOD AND IMAGE FORMING APPARATUS

BACKGROUND OF THE INVENTION

The present invention relates to a fixing apparatus for use in, for example, electrophotographic copier, which is designed to fixing an image transferred on a paper sheet, and also to a fixing method and an image forming apparatus.

An electrophotographic copier forms a toner image on the photosensitive drum and transfers the toner image to a paper sheet. The paper sheet with the toner image transferred to it is supplied to the fixing apparatus. The fixing apparatus fixes the toner image on the paper sheet.

The fixing apparatus comprises a heat roller and a press set in press contact with the heat roller. As the paper sheet having a toner image transferred to it passes through the contact portion between the heat roller and the press roller, it is heated and pressed. The toner image is thereby fixed.

At the time of fixing the toner image, dirt such as toner may stick to the surface of the press roller. A cleaning roller made of metal is pressed onto the press roller, thereby to remove the dirt from the press roller.

To enhance the efficiency of transporting the paper sheet, the press roller of the fixing apparatus is shaped like a so-called "reversed crown," having its diameter gradually decreasing toward the middle portion from either end.

Hitherto, the cleaning roller, which is shaped straight, is pressed onto the press roller that is shaped like an reversed crown. The cleaning roller fails to contact the press roller at its middle portion, though it well contacts the press roller at its end portions.

It is therefore impossible to removed the dirt from the middle portion of the press roller. Consequently, the paper sheet may gets dirty in the process of fixing the image.

BRIEF SUMMARY OF THE INVENTION

The present invention has been made in consideration of the foregoing. The object of the invention is to provide a fixing apparatus, a fixing method and an image forming apparatus, in which a cleaning roller is made to contact a fixing roller to remove dirt.

A fixing apparatus according to the invention comprises: fixing means having a pair of fixing rollers and designed to fix a developer image on a medium as the medium having the developer image transferred passes through a nip between the fixing rollers, one of the fixing rollers having a smaller diameter at a middle portion than at either end portion; and a cleaning roller set in contact with the one of the fixing rollers, for removing, from the one of the fixing rollers, dirt stuck to the one of the fixing rollers during a process of fixing the developer image on the medium, the cleaning roller having a larger diameter at a middle portion than at either end portion.

A fixing method according to the invention comprises the steps of: fixing a developer image on a medium as the medium having the developer image transferred passes through a nip between a pair of fixing rollers one of which has a smaller diameter at a middle portion than at either end portion; and cleaning the one of the fixing rollers, by removing dirt from the one of the fixing rollers by using a cleaning roller set in contact with the one of the fixing rollers and having a larger diameter at a middle portion than at either end portion.

An image forming apparatus according to the invention comprises: image forming means for forming an electrostatic latent image on an image carrier; developing means for applying developer to the electrostatic latent image formed by the image forming means, thereby to develop a developer image; transferring means for transferring the developer image formed by the developing means, to a medium; and fixing means for fixing the developer image transferred to the medium by the transferring means. The fixing means comprises: a pair of fixing rollers for fixing the developer image on the medium as the medium passes through a nip between the fixing rollers, one of the fixing rollers having a smaller diameter at a middle portion than at either end portion; and a cleaning roller set in contact with the one of the fixing rollers, for removing the developer from the one of the fixing rollers, the cleaning roller having a larger diameter at a middle portion than at either end portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention, which is shown in the accompanying drawings, will be described below.

Figure 1:
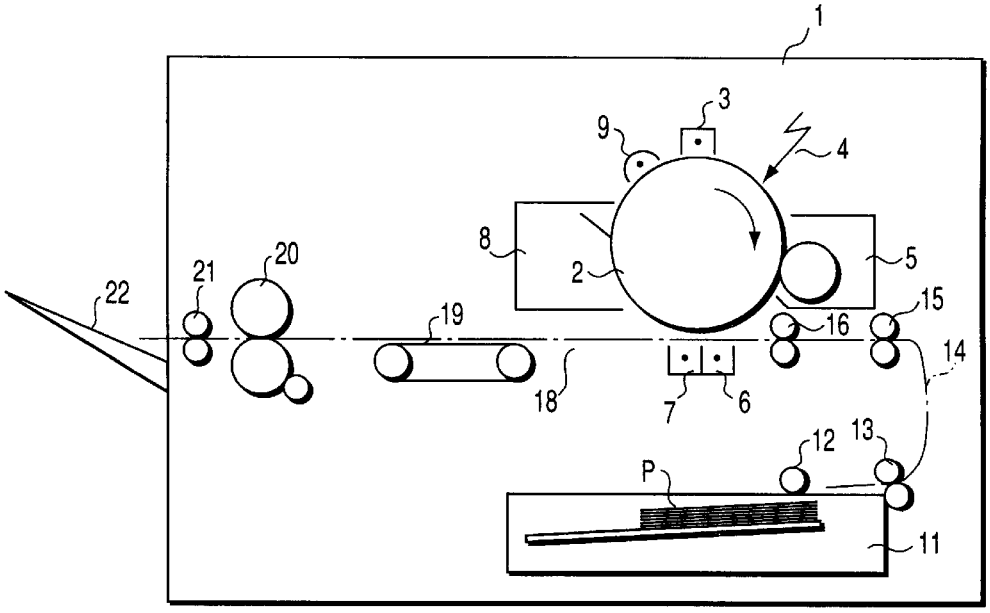
FIG. 1 is a diagram showing the internal structure of an electrophotographic apparatus which is an embodiment of the present invention.

FIG. 1 is a diagram showing the internal structure of an electrophotographic copier, which is an image forming apparatus according to the invention.

In the figure, the numeral 1 designates the main body of the copier. A photosensitive drum 2 is provided in the center part of the main body 1 and can be rotated. Around the circumference of the photosensitive drum 2, a main charger 3, an exposure section 4 functioning as means for forming a latent image, a developing device 5 providing as developing means, a transfer charger 6 used as transfer means, a separation charger 7, a cleaning device 8 and a discharging device 9 are arranged in the direction in which the drum 2 is rotated.

The main charger 3 electrically charges the surface of the photosensitive drum 2 to a predetermined potential. The exposure section 4 forms an latent image corresponding to an original image.

The transfer charger 6 transfers the toner image from the photosensitive drum 2 to a paper sheet that is used as a recording medium. The separation charger 7 peels the paper sheet, which has the toner image transferred to it, from the photosensitive drum 2.

The cleaning device 8 removes residual toner, i.e., developing agent, from the photosensitive drum 2. The discharging device 9 discharges the residual surface potential from the photosensitive drum 2.

A paper cassette 11 is provided in a lower part of the main body 1 of the copier, for storing paper sheets P which are used as recording media. A pickup roller 12 and a paper-feeding roller 13 are arranged at an upper edge of the paper cassette 11. The pickup roller 12 picks a paper sheet P from the cassette 11. The paper-feeding roller 13 feeds the paper sheet P the pickup roller 12 has taken out of the cassette 11.

The paper sheet P fed from the paper-feeding roller 13 is conveyed through a first conveying path 14. In the first conveying path 14 there are provided a pair of conveying rollers 15 and a pair of register rollers 16. The transfer charger 6 and the separation charger 7, both described above, are arranged in the first conveying path 14, too.

The paper sheet P conveyed from the separation charter 7 is further conveyed through a second conveying path 18. A conveyor belt 19, a fixing apparatus 20, and a pair of ejection rollers 21 are arranged in the second conveying path 18. The fixing apparatus 20 fixes the toner image on the paper sheet P. The ejection rollers 21 eject the paper sheet P with the toner image fixed on it. A copy tray 22 is provided on the output side of the ejection rollers 21, for receiving the paper sheet P ejected by the rollers 21.

In order to form an image, the main charger 3 electrically charges the surface of the photosensitive drum 2. The exposure section 4 forms an electrostatic latent image on the surface of the photosensitive drum 4, thus electrically charged. The latent image, which corresponds to the original image, is moved to the developing device 5 as the photosensitive drum rotates. The developing device 5 applies toner to the latent image. The latent image is thereby developed into a toner image.

In the meantime, the pickup roller 12 rotates, taking a paper sheet P. The paper-feeding roller 13 feeds the paper sheet P forward, while holding the sheet P. The register rollers 16 register the paper sheet P. The sheet P thus registered is conveyed to a position between the photosensitive drum 2 and the transfer charger 6. At this position, the toner image is transferred from the drum 2 to the paper sheet P. The separation charger 7 peels the paper sheet P, which has the toner image transferred to it, from the photosensitive drum 2. The paper sheet P is conveyed to the fixing apparatus 20. In the fixing apparatus 20, the toner image is fixed on the paper sheet P. The ejection rollers 21 eject the paper sheet P onto the copy tray 22.

Figure 2:
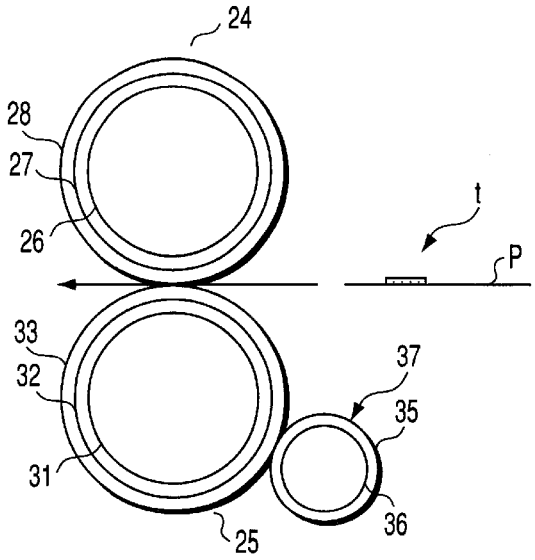
FIG. 2 is a front view of the fixing apparatus provided in the electrophotographic apparatus of FIG. 1.

FIG. 2 is a front view of the fixing apparatus 20 described above.

The fixing apparatus 20 comprises a heat roller 24 and a press roller 25, which function as a pair of fixing rollers.

The heat roller 24 is a straight roller, having a diameter $\phi$ of 60 mm. The heat roller 24 comprises a core 26, an elastic layer 27 and a surface layer 28. The core 26 is made of aluminum. The elastic layer 28 covers the core 26. The surface layer 28 is provided on the elastic layer 27.

The elastic layer 27 is made of LTV rubber or HTV rubber. The elastic layer 27 has rubber hardness of 15° (JIS-A), rubber thickness of 3 mm, and surface hardness (ASKER-C) of 60±7°. The surface layer 28 is a Teflon tube having a layer thickness of 30 to 50 $\mu$m. The elastic layer 27 and the surface layer 28 are adhered to each other with heat-resistant adhesive. The inner surface of the surface layer 28 has been etched, so that the surface layer 28 may be adhered to the elastic layer 27 more firmly than otherwise.

Like the heat roller 24, the press roller 25 comprises a core 31 made of aluminum, an elastic layer 32 covering the core 31, and a surface layer 33 provided on the elastic layer 32.

The press roller 25 is relatively hard, having rubber hardness of 45° (JIS-A). Since the press roller 25 is relatively hard, the paper sheet P can bend downwards at its leading edge as it is fed forward from the nip between the heat roller 24 and the press roller 25. This makes it easy to peel the paper sheet P from the heat roller 24. The press roller 24 has rubber thickness of 2 mm and surface hardness (ASKER-C) of 80±10°.

A fixing spring (not shown) biases the press roller 25, pressing the roller 25 onto the heat roller 24 with a load of 600 N. The nip width is 8 to 10 mm.

The process speed is controlled to 130 mm/sec. The surface temperatures of the heat roller 24 and press roller 25 are controlled to 160° C.

The toner used, forming the toner, is polyester resin or epoxy resin. The resin has glass-transition temperature (Tg) of 55° C. to 65° C. and softening point (Tm) of 100° C. to 120° C. The resin has number average molecular weight (MN) of $3\times10^3$ to $30\times10^3$ and weight average molecular weight (MW) of $3\times10^3$ to $30\times10^3$. The ratio of MN to MW, i.e., MN/MW, is 0.5 to 10. The resin contains wax having a low melting point of 70° C. to 90° C., in the weight ratio of 3% to 10% with respect of either the weight of the resin or the total weight of the resin and the wax.

A cleaning roller 35 according to this invention is located below the press roller 25 and remains in rolling contact therewith, in order to remove dirt from the press roller 25.

Figure 3:
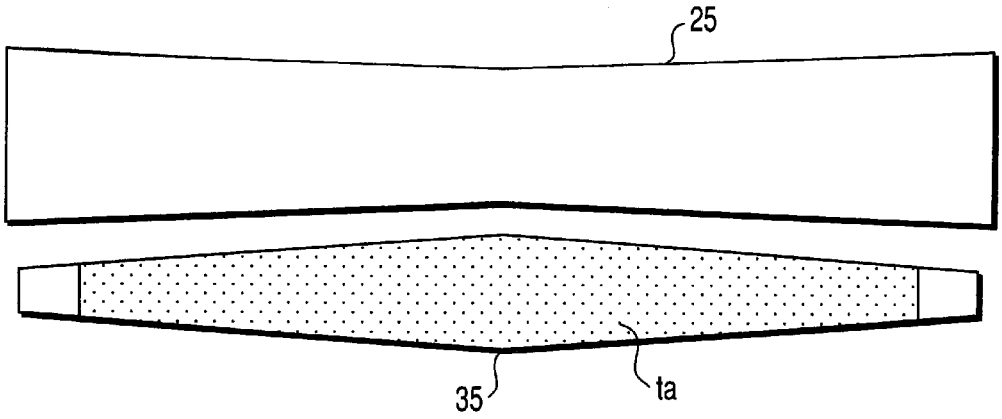
FIG. 3 is a side view showing the press roller and cleaning roller of the fixing apparatus of FIG. 2.

FIG. 3 is a side view showing the press roller 25 and cleaning roller 35.

The press roller 25 is shaped like a so-called "reversed crown," having its diameter gradually decreasing toward the middle portion from either end. The middle portion has a diameter that is 60 $\mu$m less than the diameter of either end.

The cleaning roller 35 has a core 36 made of stainless steel (SUS), free-cutting steel or aluminum. The cleaning roller 35 is 300 mm long. A spring (not shown) biases the cleaning roller 35, pressing the roller 35 onto the press roller 25 with a load of 4 N.

The surface of the cleaning roller 35 is plated with Ni or the like. Alternatively, the surface of the roller 35 is covered with a coating layer of Teflon or the like. The roller 35 has surface hardness (ASKER-C) of 100±10° . The coating layer of the cleaning roller 35 may be covered with Normex felt, Normex paper, silicone rubber, fluororubber, PPS resin or the like.

The cleaning roller 35 is shaped like a so-called "crown," having its diameter gradually increasing toward the middle portion from either end.

More precisely, the middle portion of the cleaning roller 35 has an diameter 0.1 to 2% larger than that of either end portion. The diameter $\phi$ of the middle portion is 18.02 to 18.18 mm. The difference in diameter between the middle portion and either end portion corresponds to 30% to 300% of 60 $\mu$m by which the diameter of the middle of the press roller 25 shaped like a reversed crown is less than the diameter of either end.

The condition in which the press roller 25 shaped like a reversed crown and the cleaning roller 35 shaped like a crown contact each other was examined. The rollers 25 and 35 were found in uniform contact over their entire length, with a nip width of 1 to 2 mm.

The operation of the fixing apparatus will be now described.

The paper sheet P, with the toner image transferred to it in the image-transferring section, is fed into the nip between the heat roller 24 and the press roller 25. The heat roller 24 heats the toner on the paper sheet P, and the press roller 25 presses the paper sheet P. The toner image is thereby fixed on the paper sheet P. The paper sheet P with the toner image thus fixed to it is peeled from the heat roller 24, fed therefrom through the nip between the ejection rollers 21 and ejected onto the copy tray 22.

At the time of fixing the toner image, dirt such as the toner sticks to the heat roller 24. The dirt on the heat roller 24 may stick to the press roller 25, making the press roller 25 dirty. The cleaning roller 35 removes the dirt ta from the press roller 25, thus cleaning the press roller 25.

As described above, the cleaning roller 35 is shaped like a crown, while the press roller 25 is shaped like an inverted crown, in the present invention. The cleaning roller 35 can therefore be pressed onto the press roller 25, uniformly along its entire length. Hence, the cleaning roller 35 can reliably remove the dirt from the surface of the press roller 25, attaining good cleaning ability.

The embodiment described above is an electrophotographic copier which makes monochrome copies. Nonetheless, the invention is not limited to this copier. It may be applied to a full-color copier designed to form a toner image whose density is adjusted to 1.8 in accordance with a chart in which yellow (Y), magenta (M), cyan (C) and black occupy each 8% of the area of an A4-size paper sheet.

This full-color copier was subjected to life test, in which the copier was operated, forming images on 60 K paper sheets. The results will be described below.

Figure 4:
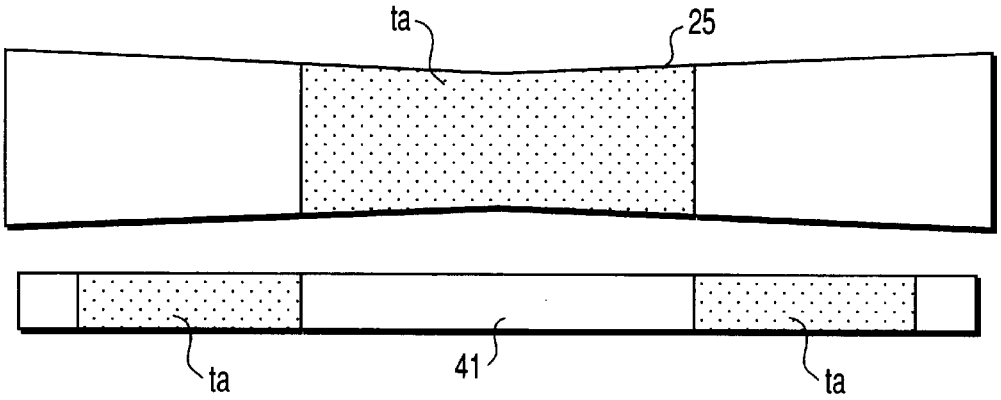
FIG. 4 is a side view showing a press roller and a cleaning roller, both being of conventional types.

A case will be described, where a conventional cleaning roller 41, which has the same diameter over its entire length, was used as shown in FIG. 4.

In this case, the dirt appeared on the reverse side of the paper sheet after the copier formed the image on 20 K paper sheets.

Both end portions of the cleaning roller 41 had dirt ta, such as the toner and the like removed from the press roller 25, while the middle portion, 100 mm long, was not dirty with toner or the like. The cleaning roller 41 effected but insufficient cleaning.

Investigation was conducted to determine why so. It was found that press roller 25 did not contact the straight cleaning roller 41 since the press roller 25 is shaped like an inverted crown. This contact failure was the cause of the insufficient cleaning.

The contact between the press roller 25 and the cleaning roller 41 was evaluated by applying light from above, by using a pen light, while an all-black image is placed on the opposite side. Any part of the image that glistened was regarded as indicating a gap between the press roller 25 and the cleaning roller 41.

Figure 5:
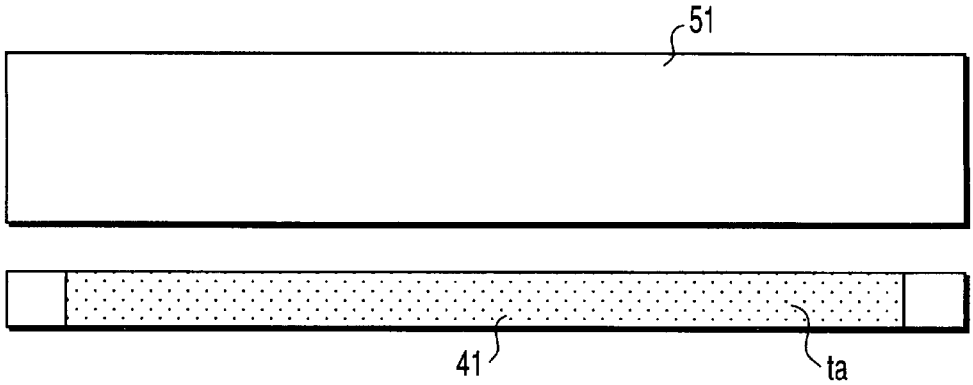
FIG. 5 is a side view showing a straight press roller and a straight cleaning roller, illustrating how the cleaning roller removes dirt from the press roller.

Then, as shown in FIG. 5, the press roller 25 was replaced by one 51 which has the same diameter over its entire length, and a life test was conducted as described above, for comparison with the case shown in FIG. 4.

In this case, dirt ta such as toner stuck to the entire surface of the cleaning roller 41, whereas no dirt stuck to the press roller 51.

The contact between the press roller 51 and the cleaning roller 41 was examined. The rollers 51 and 41 were found to contact each other uniformly at the nip having a width of 1 to 2 mm, all over their lengths.

In view of this, it is understood that the shape of the press roller 25, i.e., the shape of an inverted crown, caused the cleaning roller 41 to perform but insufficient cleaning as has been explained with reference to FIG. 4.

In the case shown in FIG. 5, however, the copy sheet had wrinkles that occupied about 3% of its area. This is because the press roller 51 is not shaped like an inverted crown.

Moreover, a life test similar to the above-described one was conducted, using the press roller 25 and cleaning roller 35 according to the present invention.

In this life test, no dirt appeared on the press roller 25 even after the image had formed been on 60 K paper sheets. That is, the cleaning roller 35 had removed all dirt ta from the press roller 25. Furthermore, no dirt appeared on the copied sheets.

As indicated above, the difference in diameter between the middle portion and either end portion of the cleaning roller 35 shaped like a crown is set at 30% to 300% of the difference in diameter between the middle portion and either end portion of the press roller 25 which is shaped like a reversed crown. If the difference is greater than 300% of the difference in diameter between the middle portion and either end portion of the press roller 25, the rollers 25 and 35 will not firmly contact at end portions, resulting in inadequate cleaning. Conversely, if the difference is less than 30% of the difference in diameter between the middle portion and either end portion of the press roller 25, the rollers 25 and 35 will not firmly contact at middle portion, resulting in insufficient cleaning.

The cleaning roller cleans the press roller in the embodiment described above. Instead, the cleaning roller may cleans the heat roller, in which case the same advantage can be attained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

fixing means having a pair of fixing rollers and designed to fix a developer image on a medium as the medium having the developer image transferred passes through a nip between the fixing rollers, one of the fixing rollers having a smaller diameter at a middle portion than at either end portion; and a cleaning roller set in contact with said one of the fixing rollers, for removing, from said one of the fixing rollers, dirt stuck to said one of the fixing rollers during a process of fixing the developer image on the medium, said cleaning roller having a larger diameter at a middle portion than at either end portion.

2. The fixing apparatus according to claim 1, wherein said fixing rollers are a heat roller and a press roller pressed on the heat roller.

3. The fixing apparatus according to claim 2, wherein said one of the fixing rollers is a press roller which has a diameter gradually decreasing toward the middle portion from either end portion, and said cleaning roller has a diameter gradually increasing toward the middle portion from either end portion.

4. The fixing apparatus according to claim 3, wherein the difference in diameter between the middle portion and either end portion of the cleaning roller is 30% to 300% of the difference in diameter between the middle portion and either end portion of the press roller.

5. The fixing apparatus according to claim 3, wherein the press roller has surface hardness (ASKER-C) of 80±10°, and the cleaning roller has surface hardness (ASKER-C) of 100±10°.

6. A fixing method comprising the steps of:

fixing a developer image on a medium as the medium having the developer image transferred passes through a nip between a pair of fixing rollers one of which has a smaller diameter at a middle portion than at either end portion; and cleaning said one of the fixing rollers, by removing dirt from said one of the fixing rollers by using a cleaning roller set in contact with said one of the fixing rollers and having a larger diameter at a middle portion than at either end portion.

7. The fixing method according to claim 6, wherein said fixing rollers are a heat roller and a press roller pressed on the heat roller.

8. The fixing apparatus according to claim 7, wherein said one of the fixing rollers is a press roller which has a diameter gradually decreasing toward the middle portion from either end portion, and said cleaning roller has a diameter gradually increasing toward the middle portion from either end portion.

9. The fixing apparatus according to claim 8, wherein the difference in diameter between the middle portion and either end portion of the cleaning roller is 30% to 300% of the difference in diameter between the middle portion and either end portion of the press roller.

10. The fixing apparatus according to claim 8, wherein the press roller has surface hardness (ASKER-C) of 80±10°, and the cleaning roller has surface hardness (ASKER-C) of 100±10°.

11. An image forming apparatus comprising:

image forming means for forming an electrostatic latent image on an image carrier;

developing means for applying developer to the electrostatic latent image formed by the image forming means, thereby to develop a developer image;

transferring means for transferring the developer image formed by the developing means, to a medium; and fixing means for fixing the developer image transferred to the medium by the transferring means, said fixing means comprising:

a pair of fixing rollers for fixing the developer image on the medium as the medium passes through a nip between the fixing rollers, one of the fixing rollers having a smaller diameter at a middle portion than at either end portion; and a cleaning roller set in contact with said one of the fixing rollers, for removing the developer from said one of the fixing rollers, said cleaning roller having a larger diameter at a middle portion than at either end portion.

12. The fixing method according to claim 1, wherein said fixing rollers are a heat roller and a press roller pressed on the heat roller.

13. The fixing apparatus according to claim 12, wherein said one of the fixing rollers is a press roller which has a diameter gradually decreasing toward the middle portion from either end portion, and said cleaning roller has a diameter gradually increasing toward the middle portion from either end portion.

14. The fixing apparatus according to claim 13, wherein the difference in diameter between the middle portion and either end portion of the cleaning roller is 30% to 300% of the difference in diameter between the middle portion and either end portion of the press roller.

15. The fixing apparatus according to claim 13, wherein the press roller has surface hardness (ASKER-C) of 80±10°, and the cleaning roller has surface hardness (ASKER-C) of 100±10°.

* * * * *